US009634430B1

(12) United States Patent
Yu

(10) Patent No.: US 9,634,430 B1
(45) Date of Patent: Apr. 25, 2017

(54) CARD EDGE CONNECTOR

(71) Applicant: T-CONN PRECISION CORPORATION, New Taipei (TW)

(72) Inventor: Chien-Yi Yu, New Taipei (TW)

(73) Assignee: T-CONN PRECISION CORPORATION, New Taipei (TW)

( * ) Notice: Subject to any disclaimer, the term of this patent is extended or adjusted under 35 U.S.C. 154(b) by 0 days.

(21) Appl. No.: 15/169,789

(22) Filed: Jun. 1, 2016

(51) Int. Cl.
*H01R 13/62* (2006.01)
*H01R 13/627* (2006.01)
*H01R 12/73* (2011.01)

(52) U.S. Cl.
CPC ..... *H01R 13/6275* (2013.01); *H01R 12/737* (2013.01)

(58) Field of Classification Search
CPC ..... H01R 12/737; H01R 13/6275
USPC ..... 439/328, 326, 157, 159, 327
See application file for complete search history.

(56) References Cited

U.S. PATENT DOCUMENTS 5,112,242 A * 5/1992 Choy ..... H01R 12/7005 439/326
5,647,755 A * 7/1997 Hida ..... H01R 12/7005 439/157
5,766,031 A * 6/1998 Yeh ..... H01R 12/7005 439/157
5,779,494 A * 7/1998 Ito ..... H01R 12/83 439/326
5,820,396 A * 10/1998 Pan ..... H01R 12/7005 439/328
5,997,331 A * 12/1999 Tu ..... H01R 13/6273 439/328
6,042,411 A * 3/2000 Choy ..... H01R 12/7005 439/326
6,478,592 B1 * 11/2002 Hu ..... G06K 13/08 439/159
6,726,499 B1 * 4/2004 Yu ..... H01R 13/41 439/326
6,743,028 B2 * 6/2004 Wang ..... H01R 12/83 439/328
6,802,732 B1 * 10/2004 Bu ..... H01R 12/7005 439/157

(Continued)

*Primary Examiner* — Abdullah Riyami
*Assistant Examiner* — Nelson R Burgos-Guntin
(74) *Attorney, Agent, or Firm* — Bacon & Thomas, PLLC

(57) ABSTRACT

A card edge connector can allow an insertion card with a locating groove on one side to be inserted thereto, the card edge connector including: a base housing, and an elastic clamping part. Two ends of the base body have two clamping portions, one sides thereof which are opposite are concaved to form a limiting slot, respectively; the elastic clamping part is fastened within one of the clamping portions, the elastic clamping part comprising a fastening base, an elastic arm, an elastic resisting portion and a limiting portion, one end of the fastening base can be retained in the clamping portion, another end thereof being connected with the elastic arm, a partial section of the elastic arm away from the fastening base being bent to form the elastic resisting portion, which can be exposed correspondingly to the limiting slot of the clamping portion retained by the elastic clamping part, one end of the elastic arm away from the fastening base having the limiting portion, so that it can be retained in the clamping portion; thereby, the insertion card may be prevented from vibration or shaking after insertion.

10 Claims, 11 Drawing Sheets

(56) References Cited

U.S. PATENT DOCUMENTS 7,661,974 B1 * 2/2010 Sun ..... H05K 7/1431 439/327
7,717,728 B1 * 5/2010 Wang ..... H01R 12/7029 439/328
7,789,692 B2 * 9/2010 Lee ..... H01R 13/6275 439/327
8,221,149 B2 * 7/2012 Liu ..... H01R 12/73 439/327
8,337,230 B1 * 12/2012 Kurachi ..... H01R 12/79 439/328
8,388,362 B2 * 3/2013 Su ..... H01R 12/7029 439/153
8,961,211 B2 * 2/2015 Zhu ..... H01R 13/62 439/326
9,004,934 B2 * 4/2015 Xu ..... H01R 12/7029 439/327
2005/0003695 A1 * 1/2005 Tsai ..... H01R 12/721 439/328
2006/0094277 A1 * 5/2006 Yang ..... H01R 12/83 439/328
2009/0017666 A1 * 1/2009 Lim ..... H05K 7/1405 439/328
2010/0022114 A1 * 1/2010 Chiu ..... H01R 13/62988 439/328
2010/0248502 A1 * 9/2010 Miki ..... H01R 12/7029 439/62
2010/0267267 A1 * 10/2010 Zhou ..... H01R 13/62 439/328
2011/0111614 A1 * 5/2011 Kato ..... H01R 12/721 439/328
2012/0252275 A1 * 10/2012 Tajiri ..... H01R 12/585 439/630
2013/0045619 A1 * 2/2013 Zhu ..... H01R 13/6275 439/350
2013/0288504 A1 * 10/2013 Sass ..... H01R 12/7029 439/328
2014/0170875 A1 * 6/2014 Shen ..... H01R 12/7005 439/159
2015/0162685 A1 * 6/2015 Tanaka ..... H01R 12/737 439/630
2016/0013589 A1 * 1/2016 Fu ..... H01R 12/7005 439/157
2016/0043487 A1 * 2/2016 Li ..... H01R 12/7029 439/155

* cited by examiner

CARD EDGE CONNECTOR

BACKGROUND OF THE INVENTION

Field of the Invention

The invention relates to a connector, particularly relates to a card edge connector for insertion of an electronic card.

Descriptions of the Related Art

Conventionally, for current common connectors, especially card edge connectors, the volume of insertion card is relatively large, and the contact area of electrical connection of an insertion card and a connector is also relatively large, so that the insertion card is prone to shaking or vibrating relative to a card edge connector as the insertion card is inserted into the card edge connector, such that the electrical connection of the insertion card and the card edge connector is unstable.

As described in U.S. Pat. No. 7,517,239, the invention relates to an electrical connector for inserting an electrical card in, and two side-ends of the electrical card respectively include at least one notch. The electrical connector includes an insulating body, a plurality of conducting terminals, a push-out device, and an elastic body. A top of the insulating body includes a slot and multiple accommodation chases along at least one side of the slot. The conducting terminals are disposed in the accommodation chases. The push-out device is pivotally engaged with a side-end of the insulating body, and includes a clasp part for clasping the notch of one of the side-ends of the electrical card. The elastic body is disposed on another side-end of the insulating body, and includes a main part, a fixing part for positioning the elastic body, and a buckle part for correspondingly buckling the notch of the other side-end of the electrical card.

Moreover, as described in U.S. Pat. No. 8,535,077, a card edge connector for mating with a corresponding daughter card 200 with a locking notch 201 at a side thereof comprises: an insulative housing 1, a plurality of contacts 2 assembled to the insulative housing 1 and an ejector 3 and a locking member 4 set on two longitudinal ends of the insulative housing 1. The insulative housing defines a central slot 14 along the longitudinal direction. The locking member 4 is formed with a retention portion 41 and a pair of elastic arms 42 extending upwardly from the retention portion 41 and symmetrically located on two opposite sides of the central slot along a transverse direction perpendicular to longitudinal direction, each elastic arm 42 having a locking portion 321 protruding toward each other for locking with the locking notch 201 of the daughter card 200.

However, vibration or shaking issue remains after the insertion card is inserted as the above conventional connectors are used. Therefore, the inventor of the invention studies in conjunction with application of principles to propose the invention, which been reasonable designed and may solve the above problem effectively.

SUMMARY OF THE INVENTION

The main objective of the invention is to provide a card edge connector, which may constrain a card edge connector inserted thereon to solve the unstable electrical connection issue of the card edge connector due to shaking of an insertion card inserted thereon that occurs often in conventional connectors.

To realize the above objective, the invention provides a card edge connector, which can allow an insertion card to be inserted thereto, one side of the insertion card having at least a locating groove, the card edge connector including: a base housing and an elastic clamping part. The base housing comprises a terminal insertion portion and two clamping portions, which are located on two ends of the terminal insertion portion, the clamping portions and the terminal insertion portion being interlaced, the terminal insertion portion having several connection terminals inserted thereto, one sides of the two clamping portions opposite to each other being concaved to form a limiting slot, respectively, the limiting slots can guide the insertion card for the insertion card to be connected with the connection terminals in correspondence. The elastic clamping part is fastened within one of the clamping portions, the elastic clamping part comprising a fastening base, an elastic arm, an elastic resisting portion and a limiting portion, each of two opposite sides of the fastening base having a retaining portion, the retaining portions can be retained in the clamping portion, the elastic arm being in connection with the fastening base, while a partial section of the elastic arm away from the fastening base being bent to form an elastic resisting portion, which can be exposed correspondingly to the limiting slot of the clamping portion retained by the elastic clamping part, one end of the elastic arm being away from the fastening base having a limiting portion, which can be retained in the clamping portion. Wherein, as the insertion card moves along the limiting slots, and resists the elastic resisting portion, the elastic arm and the elastic resisting portion can move in a direction away from the insertion card, while the elastic resisting portion can be retained in the locating groove of the insertion card correspondingly as the insertion card is connected with the connection terminals in correspondence, such that the insertion card is constrained in a movement range of the limiting slot.

Preferably, the elastic resisting portion has at least one bent section, which comprises an inclined section, which has a slope, away from the fastening base, and a horizontal section adjacent to the fastening base. The inclined section of the elastic resisting portion can move in a direction away from the limiting slots due to resisting against the insertion card when the insertion card moves along the limiting slots.

Preferably, as the insertion card is inserted in the base housing, and the elastic resisting portion is retained in the locating groove of the insertion card correspondingly, a horizontal section of the elastic resisting portion is resisted against one side wall of the locating groove correspondingly.

Preferably, each of the clamping portions is concaved in a first direction to form a limiting slot, partial sections of the elastic clamping part are bent in the first direction to form the elastic resisting portion, and two sides, which are opposite to each other, of the fastening base have a retaining portion in a second direction, respectively.

Preferably, the elastic arm and an inner wall of the clamping portion in which the elastic arm is disposed have a gap therebetween, as the elastic resisting portion of the elastic arm is resisted by the insertion card, the elastic arm can move toward the inner wall of the clamping portion, and move in the gap correspondingly.

To realize the above objective, the invention provides another card edge connector, which can allow an insertion card to be inserted thereto, one side of the insertion card having at least a locating hole, the card edge connector including: a base housing and an elastic clamping part. The base housing comprises a terminal insertion portion and two clamping portions, which are located on two ends of the terminal insertion portion, the terminal insertion portion having several connection terminals inserted thereto, one sides of the two clamping portions opposite to each other being concaved to form a limiting slot, respectively, the limiting slots can guide the insertion card for the insertion card to be connected with the connection terminals in correspondence. The elastic clamping part is fastened within one of the clamping portions, the elastic clamping part comprising a fastening base and two elastic arms, each of two opposite sides of the fastening base having a retaining portion, the retaining portions can be retained in the clamping portion, each of the elastic arms being in connection with the fastening base, while each of the opposite sides of the two elastic arms forms an elastic resisting portion, which can be exposed correspondingly to the limiting slot of the clamping portion retained by the elastic clamping part, one end of each of the elastic arms being away from the fastening base having a limiting portion, which can be retained in the clamping portion. Wherein, as the insertion card moves along the limiting slots, and is resisted against the elastic resisting portions, each of the elastic resisting portions can move in a direction away from the other elastic resisting portion, while the elastic resisting portion can be retained in the locating hole of the insertion card correspondingly as the insertion card is connected with the connection terminals in correspondence, such that the insertion card is constrained in a movement range of the limiting slot.

Preferably, one side of each of the elastic resisting portions away from the fastening base has an inclined portion, another side of each of the elastic resisting portion opposite to the inclined portion has a resisting portion, each of the inclined portions can move in a direction away from the other inclined portion due to resisting by the insertion card as the insertion card moves along the limiting slots.

Preferably, a distance between the two elastic resisting portions is less than a thickness of the insertion card.

Preferably, each of clamping portions is concaved in a first direction to form a limiting slot, one sides of the two elastic arms opposite to each other have an elastic resisting portion in a second direction, respectively, two opposite sides of the fastening base have a retaining portion in the second direction, respectively.

Preferably, each of the elastic arms and an inner wall of the clamping portion in which the elastic clamping part is disposed have a gap therebetween. As the elastic resisting portion of each of the elastic arms is resisted by the insertion card, each of the elastic arms can move toward the inner wall of the clamping portion, and move in the gap correspondingly.

The practical effect of the invention is to enhance mechanical connectivity between the card edge connector and the insertion card inserted thereon effectively through disposition of the elastic clamping part, and structures of the elastic resisting portion, the retaining portion and the limiting portion thereof to, thereby, prevent the insertion card from vibration or shaking after insertion.

For further understanding of features and technical contents of the invention, refer to the detailed description and the attached drawings with respect to the invention, in which the drawings are for reference and are illustrative only without limitation to the invention.

DETAILED DESCRIPTION OF THE PREFERRED EMBODIMENT

First Embodiment

An implementation of a card edge connector according to the invention is described by way of specific embodiments. Other advantages and effects of the invention may be understood apparently by those skilled in the art from contents disclosed in the specification. The invention may also be implemented or applied by way of other different embodiments. Various modifications and changes to various details in the specification may be based on different perspectives and applications without departing from scope of the invention. Further, the drawings of the invention are for describing technical contents only, and are not drawn in actual scales. The concept of the invention is detailed further in an implementation below, while scope of the invention is not limited to any concept.

Figure 1:
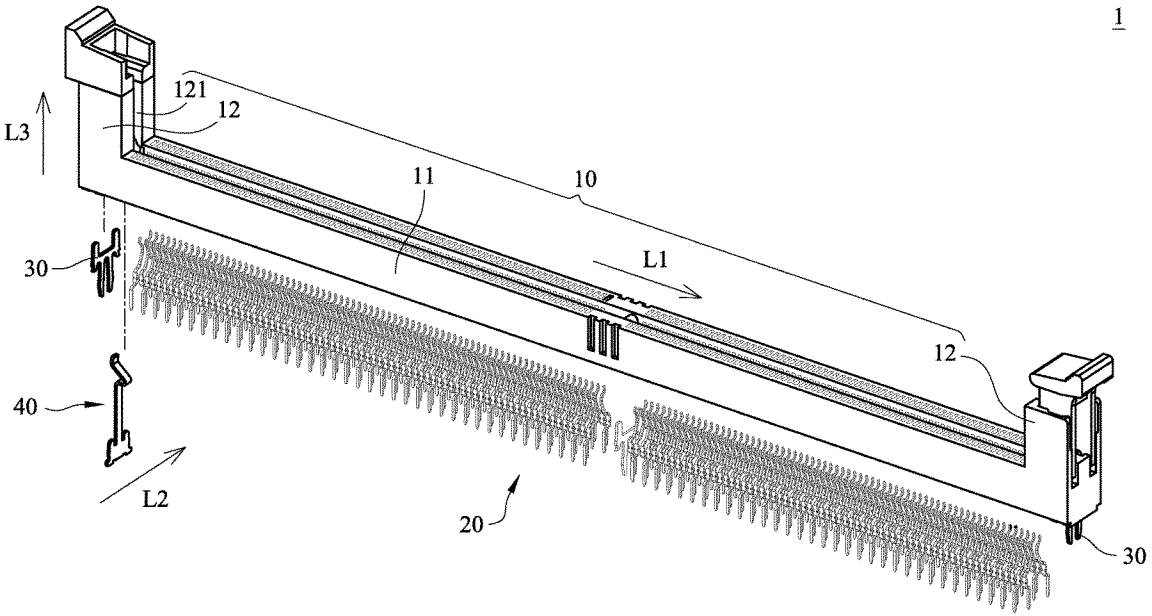
FIG. 1 is a stereo exploded schematic diagram showing a first embodiment of a card edge connector according to the invention.

Refer to FIG. 1, which is an exploded schematic diagram showing a card edge connector according to the invention. As shown in the figure, the card edge connector 1 comprises a base housing 10, several connection terminals 20, two plate fasteners 30 and an elastic clamping part 40. The base housing 10 comprises a terminal insertion portion 11 and two clamping portions 12, the two clamping portions 12 being connected to two ends of the terminal insertion portion 11, and the two clamping portions 12 and the terminal insertion portion 11 being interlaced, while the terminal insertion portion 11 having several connection terminals 20 inserted thereto. Specifically, the two clamping portions 12 are disposed vertically on two ends of the terminal insertion portion 11 disposed transversely. One sides, which are opposite to each other, of the two clamping portions 12 are concaved to form a limiting slot 121, respectively. The limiting slots 121 can guide an insertion card for the insertion card to be connected with the connection terminals 20 accurately, rapidly along the limiting slots 121. In a practical application, the base housing 10 is made of insulating material. Wherein, each of the clamping portions 12 may have a plate fastener 30 disposed thereon, and an end of each of the plate fasteners 30 is exposed to the clamping portion 12, while each of the plate fasteners 30 may be fastened correspondingly onto a circuit board (not shown) fastened by the card edge connector 1, such that mechanical connection between the card edge connector 1 and the circuit board may be enhanced to prevent looseness or shaking thereof.

Figure 2:
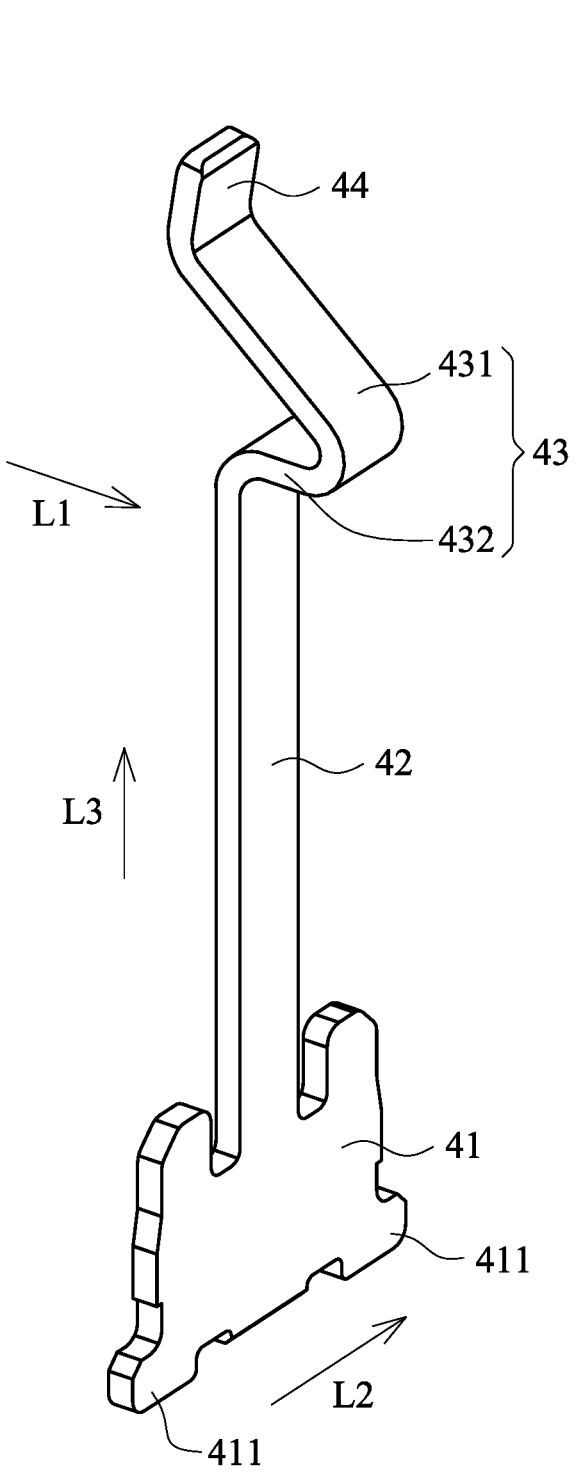
FIG. 2 is a stereo schematic diagram showing an elastic clamping part in the first embodiment of the card edge connector according to the invention.

Refer to both FIGS. 1 and 2, in which FIG. 2 is a stereo schematic diagram showing the elastic clamping part 40. As shown in the figures, the elastic clamping part 40 is fastened in one of the clamping portions 12, the elastic clamping portion 12 comprising a fastening base 41, an elastic arm 42, an elastic resisting portion 43 and a limiting portion 44. Two sides, which are opposite to each other, of the fastening base 41 have a retaining portion 411, respectively. The elastic arm 42 is connected with the fastening base 41. A partial section of the elastic arm 42 away from the fastening base 41 is bent to form an elastic resisting portion 43. An end of the elastic arm 42 away from the fastening base 41 has a limiting portion 44. Specifically, each of the clamping parts 12 is concaved in a first direction L1 to form a limiting slot 121, partial sections of the elastic clamping part 40 are bent in the first direction L1 to form an elastic resisting portion 43, and two sides, which are opposite to each other, of the fastening base 41 have a retaining portion 411 in a second direction, respectively; wherein the first direction L1 is perpendicular to the second direction L2. In consequence, by means of the retaining portion 411 disposed in the second direction L2, a movement of the elastic clamping part 40 in a third direction L3 will be stopped, so that the insertion card may be limited and locked, and the elastic clamping part 40 may be prevented effectively from moving leftward or rightward in the second direction L2 easily due to external force.

Figure 3:
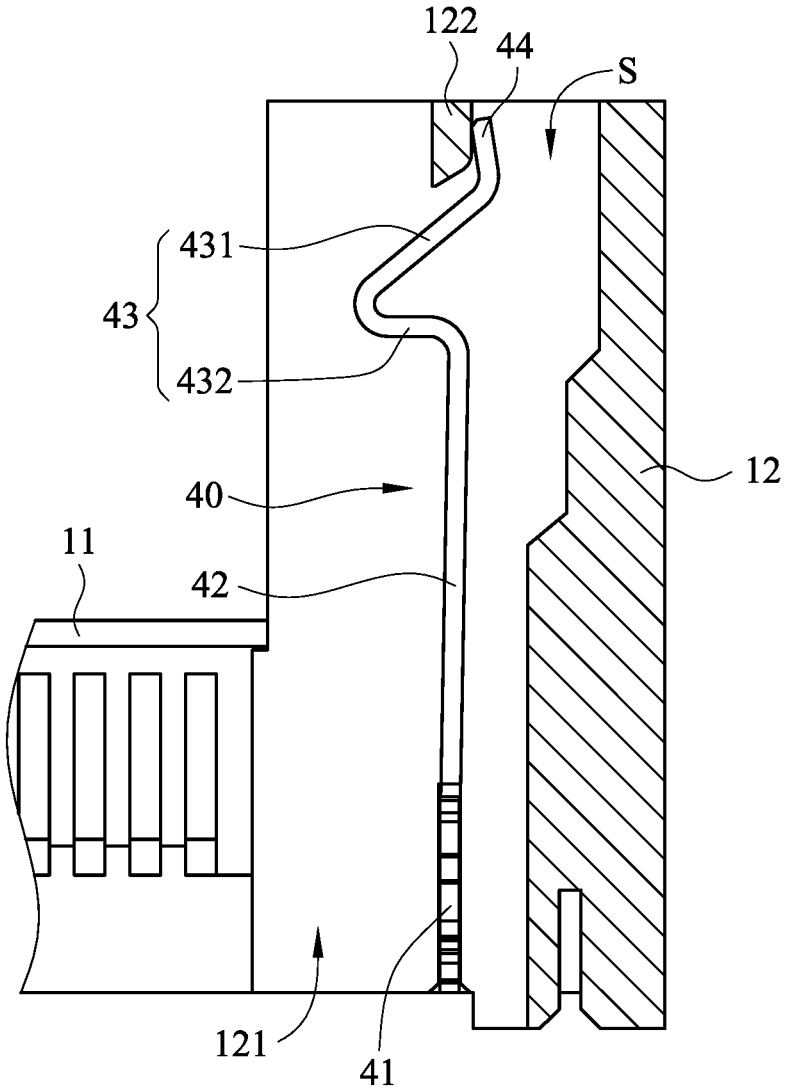
FIG. 3 is a side cross-sectional schematic diagram showing the first embodiment of the card edge connector according to the invention.

Refer to FIG. 3, which is a side schematic diagram showing the elastic clamping part 40 fastened in the base housing 10. As shown in the figure, when the elastic clamping part 40 is fastened within the base body 10, the elastic resisting portion 43 of the elastic clamping part 40 will be exposed to the limiting slot 121 correspondingly, and the limiting portion 44 of the elastic clamping part 40 and a locating convex portion 122 of the clamping portion 12 are resisted with each other, such that a movement range of the elastic clamping part 40 in the first direction L1 can be constrained accordingly. In addition, as the elastic clamping part 40 is disposed in the clamping portion 12, a gap S exists between the elastic clamping part 40 and an inner wall of the clamping portion 12, and the elastic clamping part 40 can move toward the inner wall of the clamping portion 12.

Figure 4:
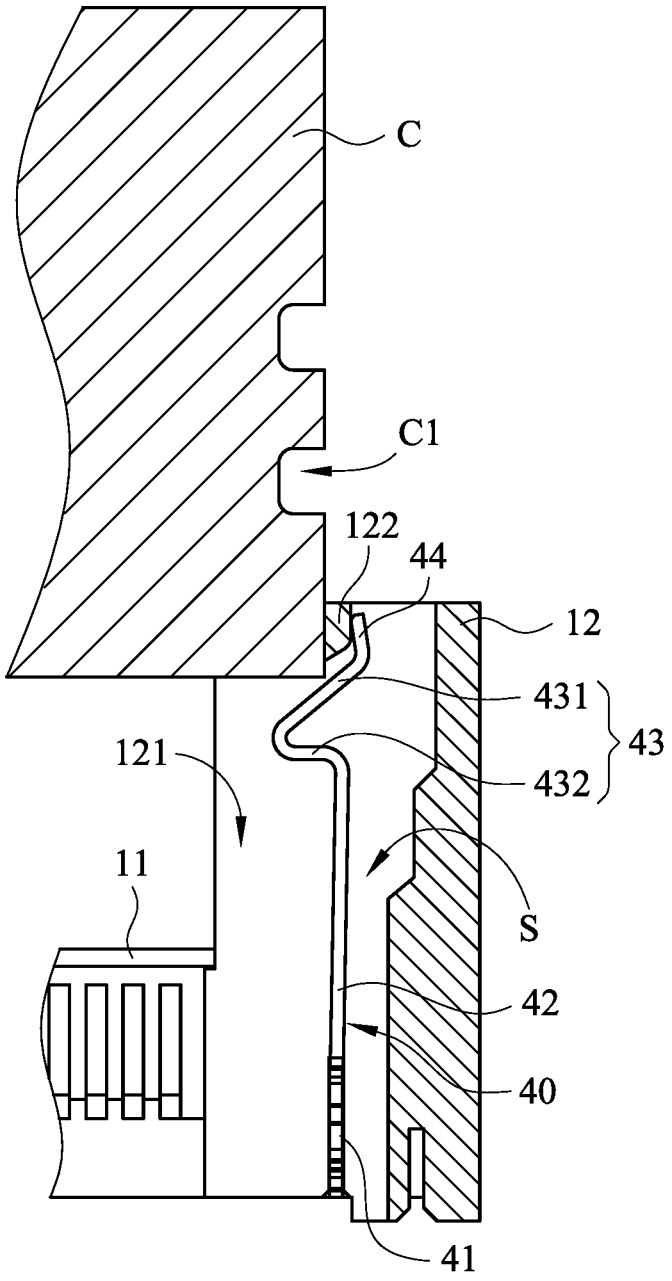
FIGS. 4 to 6 are side cross-sectional schematic diagrams showing actions when the insertion card in the first embodiment of the card edge connector is inserted to the card edge connector according to the invention.
Figure 5:
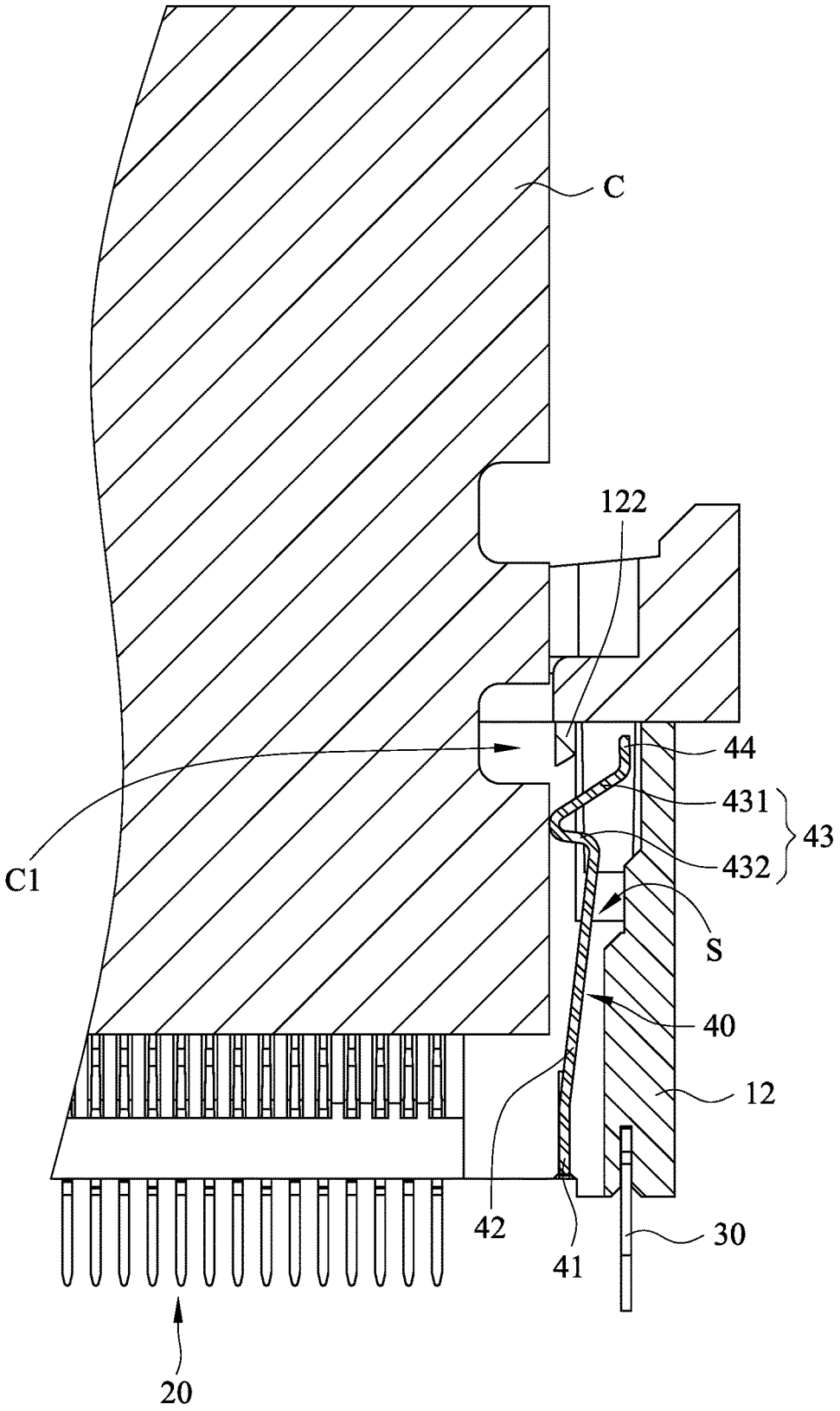
Figure 6:
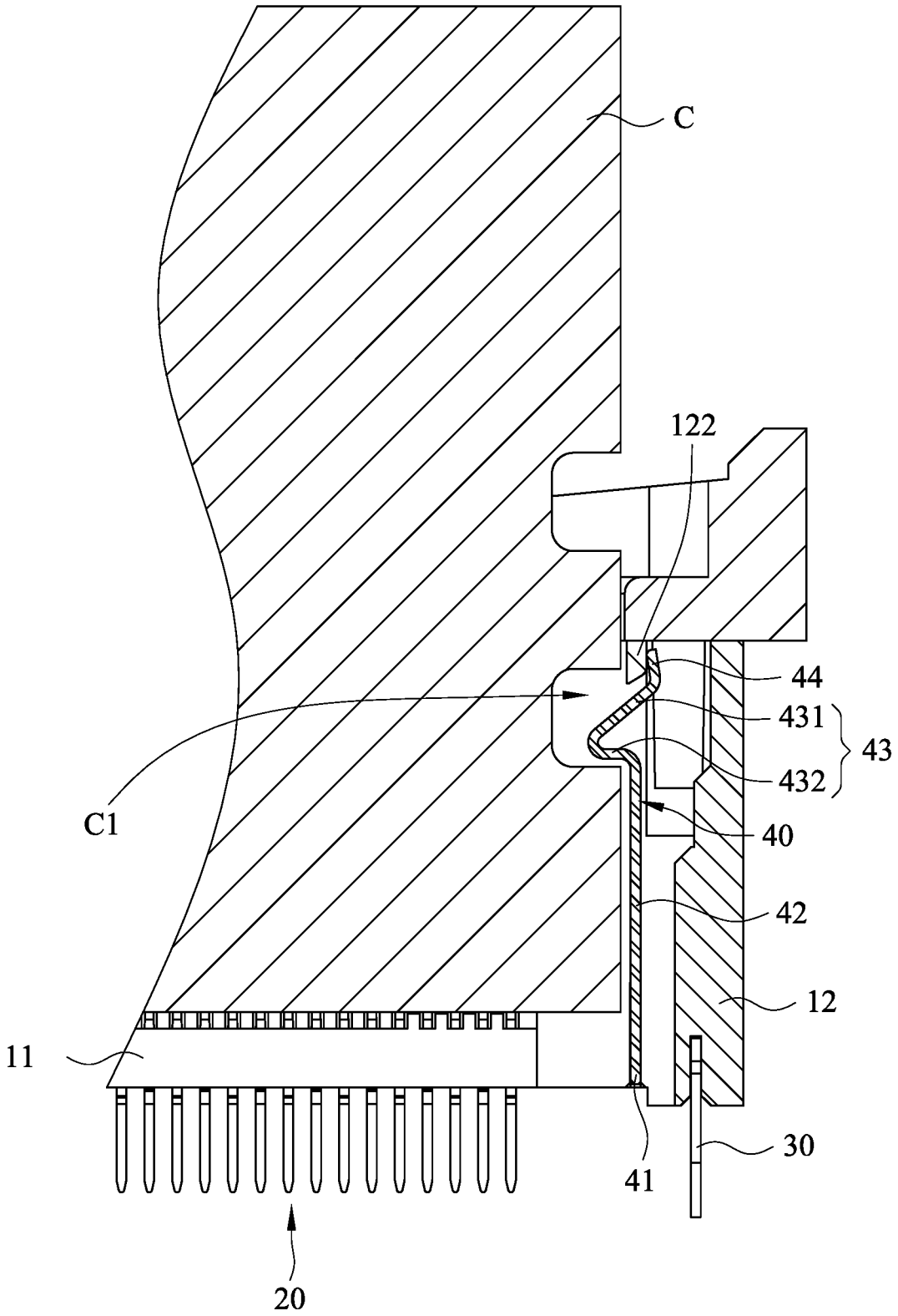

Refer to FIGS. 4 to 6, which are schematic diagrams showing actions when an insertion card C is inserted in the card edge connector 1. As shown in the figures, the elastic resisting portion 43 may have at least one bent section, wherein an inclined section 431 provided away from the fastening base 41 has a slope, and forms an included angle with a horizontal section 432 provided adjacent to the fastening base 41, and a length of the inclined section 431 of the elastic resisting portion 43 may be greater than that of the horizontal section 432; moreover, a shape of the elastic resisting portion 43 may be formed as a trapezoid shape with an inclined section, a vertical section and a horizontal section. As such, when the insertion card C moves along the limiting slot 121 and inserted to the card edge connector 1, a front edge of the insertion card C will be resisted against the inclined section 431 of the elastic resisting portion 43 at first, and then the elastic arm 42 will move in a direction away from the limiting slot 121 (a direction toward the inner wall of the clamping portion 12) accordingly to generate an elastic restoring force in correspondence. Thereby, the elastic resisting portion 43 will be resisted against a side of the insertion card C continuously due to the elastic restoring force (as shown in FIG. 5).

As shown in FIG. 6, as the insertion card C and the terminal insertion portion 11 are inserted with each other in correspondence, a locating groove C1 of the insertion card C will be located correspondingly at a location where the elastic resisting portion 43 is, and the elastic resisting portion 43 will be retained in the locating groove C1 of the insertion card C due to the elastic restoring force, while the horizontal section 432 of the elastic resisting portion 43 will be resisted against a bottom surface of the locating groove C1 of the insertion card C correspondingly to form limitation, so that the insertion card C is constrained from moving in an insertion direction thereof, i.e., the third direction L3. Thereby, the insertion card C may be prevented effectively from moving in a direction away from the base housing 10 due to external force easily. That is, as the elastic resisting portion 43 is retained in the locating groove C1 of the insertion card C, the horizontal section 432 of the elastic resisting portion 43 may enhance mechanical connectivity of the insertion card C and the card edge connector 1 to form limitation without generation of shaking.

Wherein, with the design that the insertion card C resists the inclined section 431 of the elastic resisting portion 43 before being inserted in the circuit board, the insertion card C may allow the elastic arm 42 more easily to move in a direction away from the limiting slot 121 in insertion, and allow the elastic arm 42 to have relatively larger displacement, so that the elastic arm 42 may generate a relatively larger elastic restoring force for the elastic resisting portion 43 to enter the locating groove C1 of the insertion card C more rapidly, thereby achieving a good effectiveness of operation convenience.

With the structure of the embodiment, the elastic clamping part 40 is provided with a limiting portion 44, which may be limited and locked by the locating convex portion 122 of the card edge connector 1 and deflect from an insertion end edge of the insertion card C, so that the insertion card C will not press the top of the limiting portion 44 in assembling/inserting the card edge connector 1, such that damage of terminals of the elastic clamping part is avoided. As the insertion card C is inserted/assembled to the card edge connector 1, the resisting portion of the elastic clamping part 40 is moved away, followed by being located in the locating groove C1 of the insertion card C by the elastic restoring force, while it is engaged on the bottom surface of the locating groove C1 by the horizontal section 432 of the elastic clamping part 40, such that the insertion card C is limited and locked without looseness or shaking.

Second Embodiment

Figure 7:
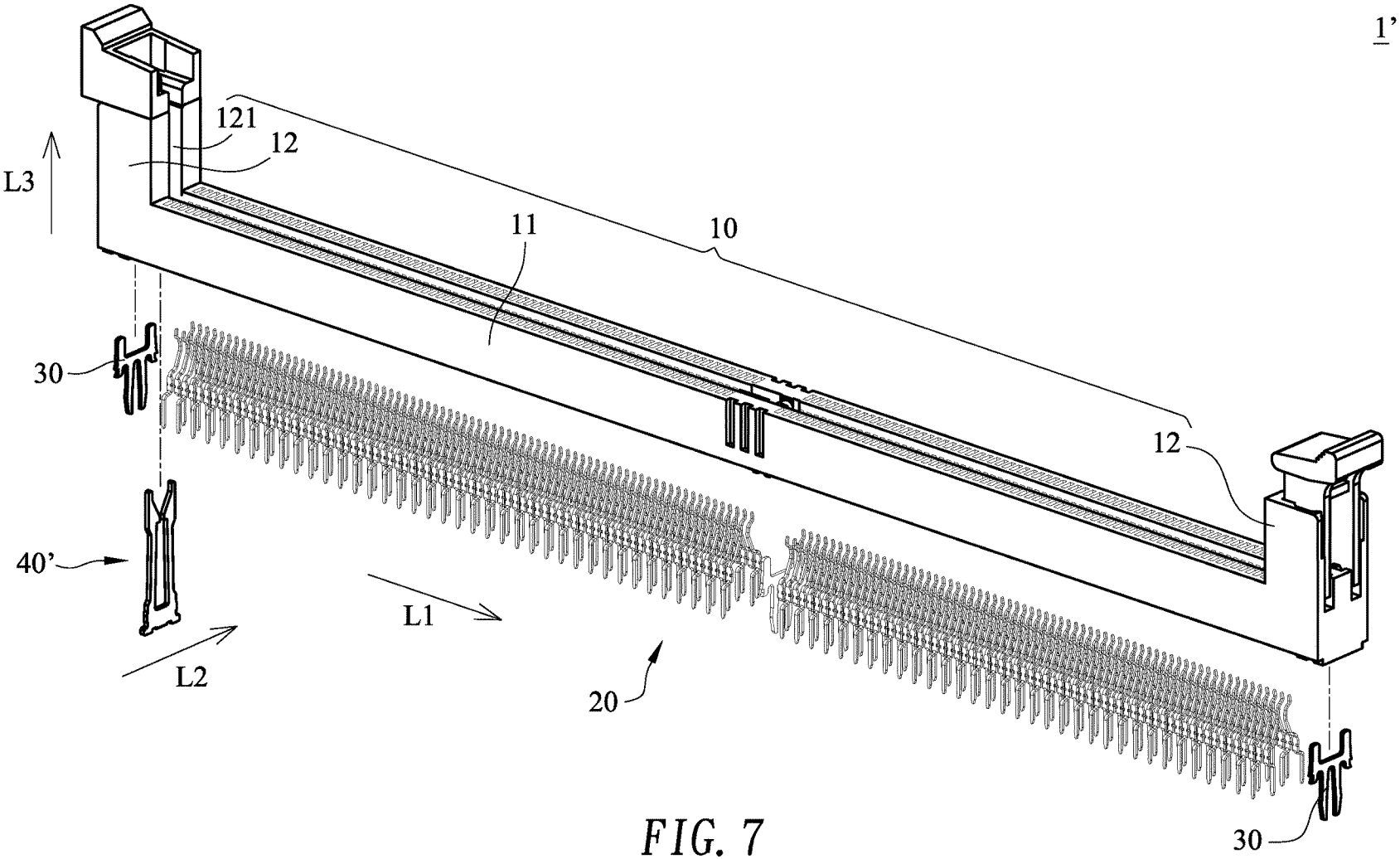
FIG. 7 is a stereo exploded schematic diagram showing a second embodiment of a card edge connector according to the invention.
Figure 8:
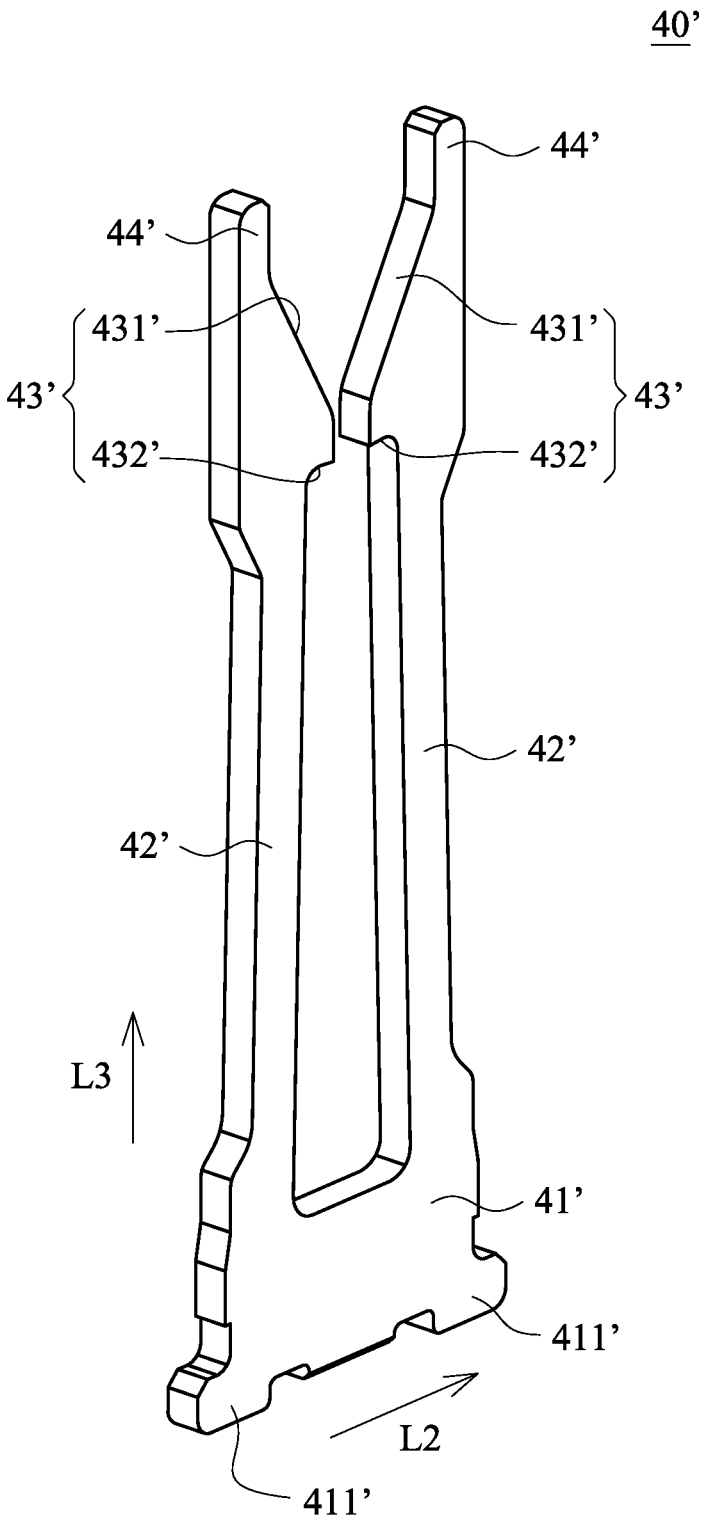
FIG. 8 is a stereo schematic diagram showing an elastic clamping part in the second embodiment of the card edge connector according to the invention.

Refer to both FIGS. 7 and 8, which are a stereo exploded schematic diagram showing a second embodiment of a card edge connector and a stereo schematic diagram showing an elastic clamping part according to the invention, respectively. As shown in the figures, the card edge connector 1' comprises a base housing 10, several connection terminals 20, two plate fasteners 30 and an elastic clamping part 40'. The embodiment differs from the aforementioned embodiment in that the structure of the elastic clamping part 40' has a different aspect in comparison to the aforementioned embodiment, and has a structure shown in FIG. 8. Connection relations of other components in this embodiment are the same as what mentioned in the aforementioned embodiment, and the description is as above, so that only the elastic clamping part 40' of this embodiment will be described in detail below.

Figure 9:
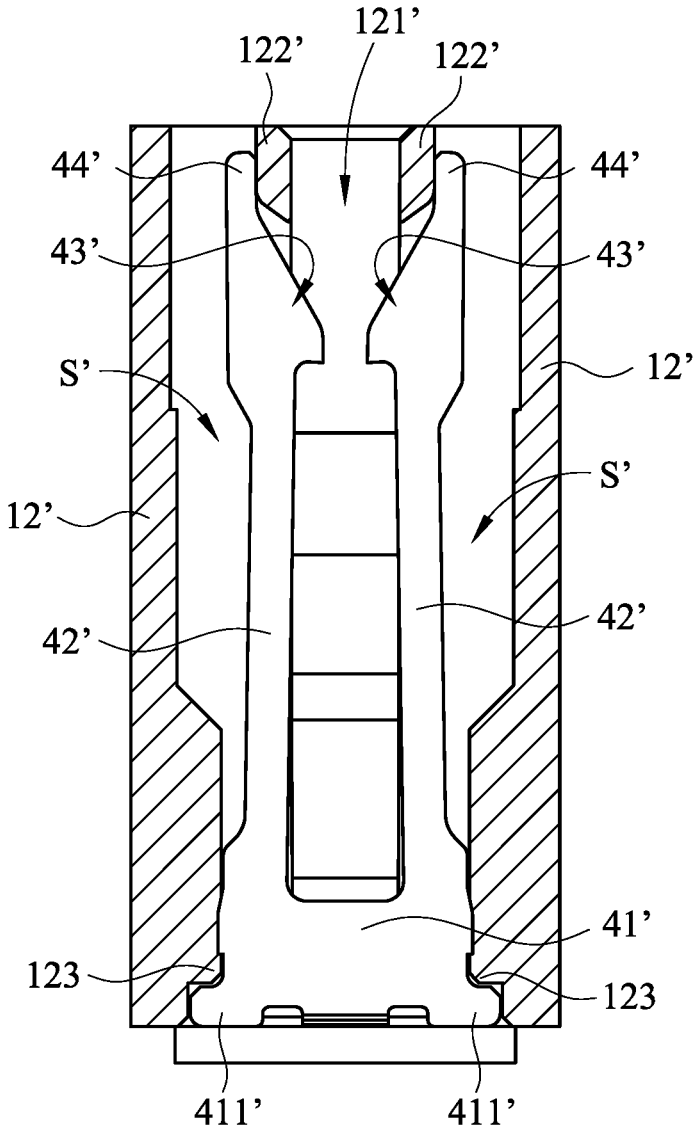
FIG. 9 is a side cross-sectional schematic diagram showing the second embodiment of the card edge connector according to the invention.

Refer to both FIGS. 8 and 9. The elastic clamping part 40' is fastened in one of the clamping portions 12'. The elastic clamping part 40' comprises a fastening base 41' and two elastic arms 42'. Two sides, which are opposite to each other, of the fastening base 41' have a retaining portion 411', respectively. The retaining portions 411' can be retained in the clamping portion 12'. As the aforementioned embodiment, the retaining portions 411' may be disposed in the second direction L2. Thereby, stability of the insertion card C1, when being inserted into the card edge connector 1', is improved to prevent effectively the insertion card C' from shaking or loosening leftward/rightward in the second direction L2 due to external force easily, and to produce stop function in the third direction L3 for limiting and locating the insertion card C'.

The two elastic arms 42' are connected with the fastening base 41', and one sides, which are opposite to each other, have an elastic resisting portion 43', respectively. Furthermore, the elastic resisting portions 43' of the two elastic arms 42' may be disposed in the second direction L2, and a distance between the two elastic resisting portions 43', which are opposite to each other, is less than a thickness of the insertion card C'. One side of the elastic resisting portion 43' of each of the elastic arms 42' away from the fastening base 41' has an inclined portion 431', while the other side, which is opposite to the inclined portion 431', of each of the elastic resisting portion 43' has a resisting portion 432'.

As shown in FIG. 9, when the elastic clamping part 40' is disposed within the clamping portion 12', the limiting portion 44' of each of the elastic arms 42' is resisted against a locating convex portion 122' of the clamping portion 12' correspondingly, while the retaining portion 411' of each of the elastic clamping parts 40' and a locating concave portion 123 of the clamping portion 12' are retained with each other correspondingly, so that the elastic clamping parts 40' can be limited in the clamping portion 12' stably, and each of the elastic resisting portions 43' of each of the elastic arms 42' will be exposed to the limiting slot 121' correspondingly, while a front edge of the insertion card C' will be resisted against the inclined portions 431' of the elastic resisting portions 43' as the insertion card C' moves along the limiting slot 121'. Wherein, as the aforementioned embodiment, each of the elastic arms 42' and an inner wall of the clamping portion 12' within which the elastic clamping part 40' is retained have a gap S' therebetween. As the elastic resisting portion 43' of each of the elastic arms 42' is resisted by the insertion card C', it can move toward the inner wall of the clamping portion 12', and move in the gap S' correspondingly.

Figure 10:
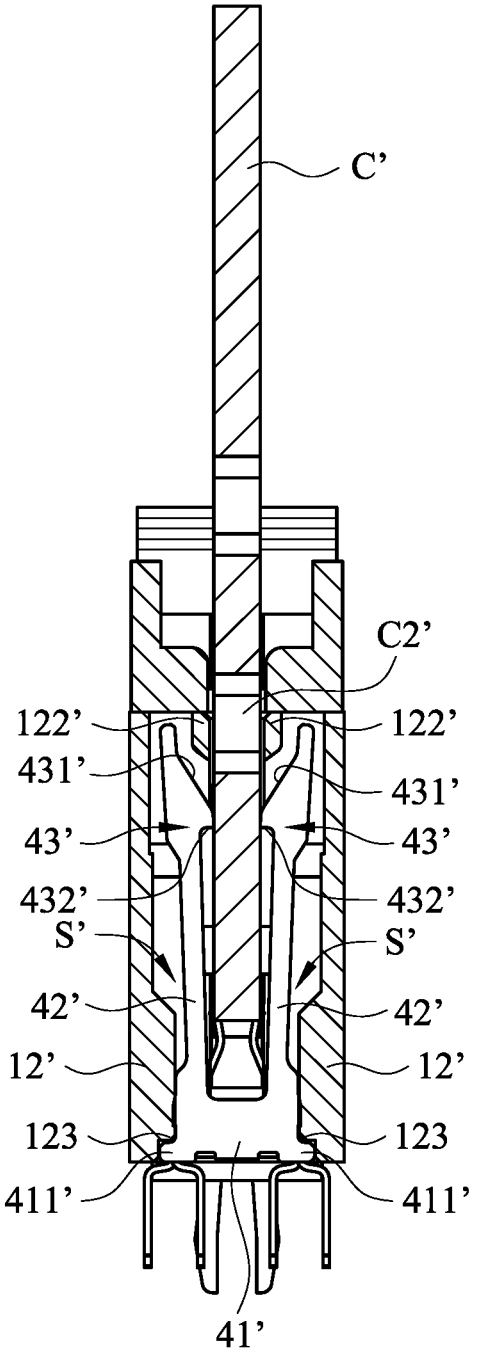
FIGS. 10 to 11 are side cross-sectional schematic diagrams showing actions when the insertion card in the second embodiment of the card edge connector is inserted to the card edge connector according to the invention.
Figure 11:
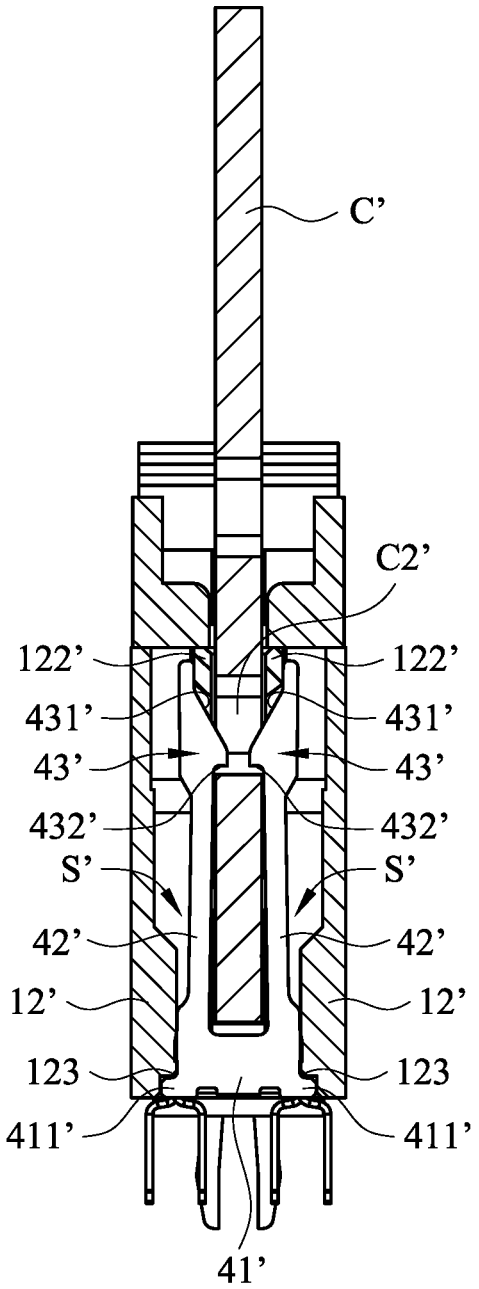

Refer to FIGS. 10 and 11, which are schematic diagrams showing actions when the insertion card C' in the second embodiment of the card edge connector 1' according to the invention is inserted in the card edge connector 1' correspondingly. As shown in the figures, when the insertion card C' moves along the limiting slot 121' and inserted in the card edge connector 1', the front edge of the insertion card C' will resist the inclined portions 431' of the two elastic resisting portions 43' at first. The two inclined portions 431' will move in directions away from each other correspondingly (directions toward the terminal insertion portion 11 on the inner wall of the clamping portion 12') after being resisted by the front edge of the insertion card C'. Thereby, each of the elastic arms 42' will generate an elastic restoring force correspondingly for the two elastic arms 42' to clamp the insertion card C1 due to the elastic restoring forces. Moreover, when the insertion card C1 and the terminal insertion portion 11 are inserted with each other, the locating hole C2' of the insertion card C1 will correspond to a location where the two elastic resisting portions 43' are, and the two elastic resisting portions 43' will be retained within the locating holes C2' correspondingly. At the same time, the resisting portion 432' of each of the elastic resisting portions 43' will be resisted against one side of the locating hole C2' correspondingly. Thereby, the insertion card C' may be constrained effectively from moving in an insertion direction thereof, so that the insertion card C' will not be shaken due to external force easily.

With the structure of the embodiment, the insertion card C' may be located in the clamping portion 12' of the card edge connector 1' by disposition of the retaining portion 411' after the insertion card C' is inserted into the card edge connector 1' to complete assemblage; the insertion card C' may be prevented from being pulled out by the elastic clamping part 40' along with being taken off because the retaining portion 411' is stopped by the locating concave portion 123. Moreover, with disposition of the limiting portion 44', the elastic clamping part 40' may be kept at a reference location to prevent the elastic clamping part 40' from inclination, which influence insertion assemblage of the insertion card C', by using the locating convex portion 122' to limit and locate the limiting portion 44' after the insertion card C' is inserted into the card edge connector 1'.

The description above are only preferred embodiments of the invention. Any equivalent modification made within the scope of claims of the invention shall be within the substantial scope of the invention.

What is claimed is:

1. A card edge connector capable of allowing an insertion card to be inserted thereto, one side of the insertion card having at least one locating groove, the card edge connector including:

a base housing comprising a terminal insertion portion and two clamping portions, which are located on two ends of the terminal insertion portion, the clamping portions and the terminal insertion portion being interlaced, the terminal insertion portion having several connection terminals inserted thereto, one side of the two clamping portions opposite to each other being concaved to form a limiting slot, respectively, the limiting slots can guide the insertion card for the insertion card to be connected with the connection terminals in correspondence;

an elastic clamping part fastened to one of the clamping portions, said elastic clamping part comprising a fastening base, an elastic arm, an elastic resisting portion and a limiting portion, each of two opposite sides of the fastening base having a retaining portion, the retaining portions can be retained in the clamping portion, the elastic arm being in connection with the fastening base, while a partial section of the elastic arm away from the fastening base being bent to form an elastic resisting portion, which can be exposed correspondingly to the limiting slot of the clamping portion retained by the elastic clamping part, one end of the elastic arm being away from the fastening base having a limiting portion, which can be retained in the clamping portion;

wherein, the insertion card moves along the limiting slots, the elastic arm and the elastic resisting portion can move in a direction away from the insertion card as the elastic resisting portion is resisted, while the elastic resisting portion can be retained in the locating groove of the insertion card correspondingly as the insertion card is connected with the connection terminals in correspondence, such that the insertion card is constrained in a movement range of the limiting slot.

2. The card edge connector according to claim 1, wherein the elastic resisting portion has at least one bent section, which has an included angle formed by an inclined section, which has a slope, away from the fastening base, and a horizontal section adjacent to the fastening base, or the elastic resisting portion can be a trapezoidal structure formed of an inclined section, a vertical section and a horizontal section; the inclined section of the elastic resisting portion can move in a direction away from the limiting slots due to resisting against the insertion card when the insertion card moves along the limiting slots.

3. The card edge connector according to claim 2, wherein the insertion card is inserted in the base housing, and as the elastic resisting portion is retained in the locating groove of the insertion card correspondingly, the horizontal section of the elastic resisting portion is resisted against the bottom of the locating groove correspondingly.

4. The card edge connector according to claim 1, wherein each of the clamping portions is concaved in a first direction to form a limiting slot, partial sections of the elastic clamping part are bent in the first direction to form the elastic resisting portion, and two sides, which are opposite to each other, of the fastening base have a retaining portion in a second direction, respectively.

5. The card edge connector according to claim 1, wherein the elastic arm and an inner wall of the clamping portion in which the elastic arm is disposed have a gap therebetween, as the elastic resisting portion of the elastic arm is resisted by the insertion card, the elastic arm can move toward the inner wall of the clamping portion, and move in the gap correspondingly.

6. A card edge connector capable of allowing an insertion card to be inserted thereto, one side of the insertion card having at least one locating hole, the card edge connector including:

a base housing comprising a terminal insertion portion and two clamping portions, which are located on two ends of the terminal insertion portion, the terminal insertion portion having several connection terminals inserted thereto, one sides of the two clamping portions opposite to each other being concaved to form a limiting slot, respectively, the limiting slots can guide the insertion card for the insertion card to be connected with the connection terminals in correspondence;

an elastic clamping part fastened to one of the clamping portions, said elastic clamping part comprising a fastening base and two elastic arms, each of two opposite sides of the fastening base having a retaining portion, the retaining portions can be retained in the clamping portion, each of the elastic arms being in connection with the fastening base, while each of the opposite sides of the two elastic arms forms an elastic resisting portion, which can be exposed correspondingly to the limiting slot of the clamping portion retained by the elastic clamping part, one end of each of the elastic arms being away from the fastening base having a limiting portion, which can be retained in the clamping portion;

wherein, as the insertion card moves along the limiting slots and resists the elastic resisting portions, each of the elastic resisting portions can move in a direction away from the other elastic resisting portion, while the elastic resisting portion can be retained in the locating hole of the insertion card correspondingly as the insertion card is connected with the connection terminals in correspondence, such that the insertion card is constrained in a movement range of the limiting slot.

7. The card edge connector according to claim 6, wherein one side of each of the elastic resisting portions away from the fastening base has an inclined portion, another side of each of the elastic resisting portion opposite to the inclined portion has a resisting portion, each of the inclined portions can move in a direction away from the other inclined portion due to resisting by the insertion card as the insertion card moves along the limiting slots.

8. The card edge connector according to claim 7, wherein a distance between the two elastic resisting portions is less than a thickness of the insertion card.

9. The card edge connector according to claim 6, wherein each of clamping portions is concaved in a first direction to form a limiting slot, one sides of the two elastic arms opposite to each other have an elastic resisting portion in a second direction, respectively, two opposite sides of the fastening base have a retaining portion in the second direction, respectively.

10. The card edge connector according to claim 9, wherein each of the elastic arms and an inner wall of the clamping portion in which the elastic clamping part is disposed have a gap therebetween, as the elastic resisting portion of each of the elastic arms is resisted by the insertion card, each of the elastic arms can move toward the inner wall of the clamping portion, and move in the gap correspondingly.

* * * * *